US007671005B2

(12) United States Patent
Mort, III et al.

(10) Patent No.: US 7,671,005 B2
(45) Date of Patent: Mar. 2, 2010

(54) ACTIVE CONTAINING DELIVERY PARTICLE

(75) Inventors: Paul R. Mort, III, Cincinnati, OH (US); Wendell Ivan Norman, Cincinnati, OH (US); George Douglas Hiler, II, Harrison, OH (US); Gregory Scot Miracle, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 825 days.

(21) Appl. No.: 11/407,617

(22) Filed: Apr. 20, 2006

(65) Prior Publication Data

US 2006/0252667 A1 Nov. 9, 2006

Related U.S. Application Data

(63) Continuation-in-part of application No. 11/012,755, filed on Dec. 15, 2004, now abandoned.

(60) Provisional application No. 60/544,666, filed on Feb. 13, 2004.

(51) Int. Cl.
*C11D 17/06* (2006.01)

(52) U.S. Cl. ..... 510/445; 510/276; 510/297; 510/301; 510/348; 510/441; 510/444; 510/438; 510/101; 510/349; 510/296

(58) Field of Classification Search ..... 510/445, 510/276, 297, 301, 348, 441, 444, 438, 101, 510/349, 296
See application file for complete search history.

(56) References Cited

U.S. PATENT DOCUMENTS

| | | | | |
|---|---|---|---|---|
| 3,723,327 | A * | 3/1973 | van Kampen et al. | 510/374 |
| 4,106,991 | A * | 8/1978 | Markussen et al. | 435/187 |
| 4,430,243 | A | 2/1984 | Bragg | |
| 4,526,698 | A * | 7/1985 | Kuroda et al. | 510/305 |
| 4,681,914 | A * | 7/1987 | Olson et al. | 510/381 |
| 4,973,417 | A * | 11/1990 | Falholt | 510/530 |
| 5,061,397 | A * | 10/1991 | Goodman | 510/334 |
| 5,178,798 | A * | 1/1993 | Jolicoeur | 510/441 |
| 5,486,303 | A | 1/1996 | Capeci | |
| 5,489,392 | A | 2/1996 | Capeci | |
| 5,516,448 | A | 5/1996 | Capeci | |
| 5,565,137 | A | 10/1996 | Capeci | |
| 5,569,645 | A | 10/1996 | Dinniwell | |
| 5,574,005 | A | 11/1996 | Welch | |
| 5,576,282 | A | 11/1996 | Miracle | |
| 5,595,967 | A | 1/1997 | Miracle | |
| 5,597,936 | A | 1/1997 | Perkins | |
| 5,691,297 | A | 11/1997 | Nassano | |
| 5,733,763 | A * | 3/1998 | Markussen et al. | 435/175 |
| 5,756,447 | A * | 5/1998 | Hall | 510/475 |
| 5,879,584 | A | 3/1999 | Bianchetti | |
| 5,879,920 | A | 3/1999 | Dale et al. | |
| 6,225,464 | B1 | 5/2001 | Hiler, II | |
| 6,268,329 | B1 * | 7/2001 | Markussen | 510/392 |
| 6,306,812 | B1 | 10/2001 | Perkins | |
| 6,326,348 | B1 | 12/2001 | Vinson | |
| 6,403,549 | B1 * | 6/2002 | De Lima et al. | 510/392 |
| 6,630,436 | B1 * | 10/2003 | York et al. | 510/392 |
| 6,794,354 | B1 * | 9/2004 | Mort et al. | 510/444 |
| 2002/0081738 | A1 * | 6/2002 | Simonsen et al. | 435/459 |
| 2002/0192775 | A1 * | 12/2002 | Becker et al. | 435/178 |
| 2003/0027739 | A1 * | 2/2003 | Dale et al. | 510/446 |

FOREIGN PATENT DOCUMENTS

| | | | |
|---|---|---|---|
| EP | 0 304 332 | A2 | 2/1989 |
| EP | 0304332 | A2 * | 8/1989 |
| EP | 0 193 829 | B1 | 9/1991 |
| EP | 0 962 424 | A1 | 12/1999 |
| EP | 1 881 059 | A1 | 1/2008 |
| WO | WO 91/06638 | A1 | 5/1991 |
| WO | WO 91/ 09941 | A1 | 7/1991 |
| WO | WO 00/17304 | * | 3/2000 |
| WO | WO 00/17304 | A1 | 3/2000 |
| WO | WO 00/32601 | A2 | 6/2000 |
| WO | WO 00/78908 | A1 * | 12/2000 |
| WO | WO 2005/080542 | A1 | 9/2005 |

OTHER PUBLICATIONS

ISO-9138—Abrasive Grains—Sampling and Splitting—published Feb. 1993.

ISO 8130-13—Coating powders—Part 13: Particle size analysis by laser diffraction.

ISO 9276-1: 1998, Representation of results of particle size analysis—Part 1: Graphical Representation, Figure A.4, Cumulative distribution Q3 plotted on graph paper with a logarithmic abscissa.

ISO 2555, second edition published Feb. 1, 1989 and reprinted with corrections Feb. 1, 1990, Plastics—resins in the liquid state or as emulsions or dispersions—Determination of Apparent viscosity by the Brookfield Test method.

ASTM D2857-95—Standard Practice for Dilute Solution Viscosity of Polymers—published Apr. 1995.

ASTM D502-89—Standard Test Method for Particle Size of Soaps and Other Detergents approved May 26, 1989.

ASTM E727-02—Standard Test Methods for Determining Bulk Density of Granular Carriers and Granular Pesticides—approved Oct. 10, 2002.

(Continued)

*Primary Examiner*—Mark Eashoo
*Assistant Examiner*—Jane L Stanley
(74) *Attorney, Agent, or Firm*—James F. McBride; Kim William Zerby; Steven W. Miller

(57) ABSTRACT

The present invention relates to non-surfactant active containing delivery particles, cleaning compositions comprising said particles, and processes for making and using the aforementioned particles and cleaning compositions. When employed in cleaning compositions, such particles provide more uniform active delivery. Thus, resulting in improved cleaning performance without the increased cleaning negatives that may be associated with higher levels of certain active levels.

19 Claims, No Drawings

OTHER PUBLICATIONS

ASTM E11-01—Standard Specification for Wire Cloth and Sieves for Testing Purposes-Published May 2001.

Jørgensen, K., et al., Impact and attrition shear breakage of enzyme granules and placebo particles-application to particle design and formulation, Powder Technology, 2005, pp. 157-167, vol. 149.

Meesters, G. M. H., Agglomeration of Enzymes, Micro-organisms and Flavours, Handbook of Powder Technology, Granulation, Edited by A. D. Salman, M. J. Hounslow, and J. P. K. Seville, Elsevier Science, 2007, pp. 555-589.

* cited by examiner

ACTIVE CONTAINING DELIVERY PARTICLE

CROSS-REFERENCES TO RELATED APPLICATIONS

This application is a continuation-in-part of and claims priority to U.S. patent application Ser. No. 11/012,755, filed Dec. 15, 2004 now abandoned, which in turn claims priority under 35 U.S.C. § 119(e) to U.S. Provisional Application Ser. No. 60/544,666 filed Feb. 13, 2004.

FIELD OF INVENTION

This invention relates to active containing delivery particles and cleaning compositions comprising such active containing delivery particles; and processes for making and using such particles and cleaning products.

BACKGROUND OF THE INVENTION

Actives, for example catalysts and enzymes, are expensive and generally less effective when employed at high levels in cleaning compositions. As a result, cleaning compositions typically comprise very low levels of actives. Unfortunately, when low levels of actives are used in a cleaning composition, it is difficult to evenly disperse the active in the cleaning composition. Thus, the consumer is likely to experience less than optimal cleaning performance and may experience certain cleaning negatives such as fabric damage.

Accordingly, there is a need for an active containing delivery particle that can provide uniform dosing of low levels of actives in cleaning compositions.

SUMMARY OF THE INVENTION

The present invention relates to non-surfactant active containing delivery particles, cleaning compositions comprising said particles, and processes for making and using such particles and cleaning compositions.

DETAILED DESCRIPTION OF THE INVENTION

Definitions

As used herein, the term "cleaning composition" includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, mouthwashes, denture cleaners, car or carpet shampoos, bathroom cleaners; hair shampoos and hair-rinses; shower gels and foam baths and metal cleaners; as well as cleaning auxiliaries such as bleach additives and "stain-stick" or pretreat types.

As used herein, the articles a and an when used in a claim, are understood to mean one or more of what is claimed or described.

It is understood that the test methods that are disclosed in the Test Methods Section of the present application must be used to determine the respective values of the parameters of Applicants' inventions as such inventions are described and claimed herein.

Unless otherwise noted, all component or composition levels are in reference to the active level of that component or composition, and are exclusive of impurities, for example, residual solvents or by-products, which may be present in commercially available sources.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited are, in relevant part, incorporated herein by reference; the citation of any document is not to be construed as an admission that it is prior art with respect to the present invention.

Non-surfactant Active Containing Delivery Particle

Applicants' active containing delivery particle comprises a first coating that comprises a non-surfactant active component, said active component being sufficiently evenly dispersed in said coating to provide a particle relative standard deviation of less than or equal to 20%, 10% or even 5%; a solid coating aid component having a median particle size of less than 50 microns, from about 0.5 microns to about 40 microns, or even from about 1 microns to about 30 microns; and a binder component, said binder component having a viscosity of less than about 4,000 cps, from about 1 cps to about 2,000 cps or even from about 5 cps to about 1,000 cps; and a core material, at least a portion of said core material being coated by said first coating, said core material having a median particle size, of at least 150 microns, from 212 microns to about 1,000 microns, or even from about 300 microns to about 850 microns and a distribution span of from 1 to about 2, from 1 to about 1.5 or even from 1 to about 1.25; and, optionally, at least one additional coating.

In one aspect of Applicants' invention, said core material has a bulk density of at least 300 grams per liter, from 300 grams per liter to about 1,600 grams per liter, or even from about 400 grams per liter to about 1,000 grams per liter.

In another aspect of Applicant's invention, said core material has a bulk density of at least 800 grams per liter or even 800 grams per liter to 1600 grams per liter.

In one aspect of Applicants' invention, said particle comprises, based on total particle weight, no more than 10 weight percent of said binder component, from about 0.5 to 10 weight percent of said binder component, or even from about 1 to about 5 weight percent of said binder component.

In one aspect of Applicants' invention, said particle comprises, based on total particle weight, no more than 20 weight percent of any single non-surfactant active, no more than 10 weight percent of any single non-surfactant active, or even no more than 5 weight percent of any single non-surfactant active.

In one aspect of Applicants' invention, said particle has a core material median particle size to solid coating aid median particle size ratio of at least 10:1, from 10:1 to about 500:1, or even from about 20:1 to about 100:1.

In one aspect of Applicants' invention, said particle comprises at least one additional coating. Each additional coating can coat any previously applied coating or any previously uncoated portion of said core material. Thus, said first coating can be coated by any additional coatings. Said additional coatings may comprise a hydrophilic material or a hydrophobic material—for example, a colloidal wax emulsion or an additional binder type material may be used.

In one aspect of Applicants' invention, said particle comprises a material selected from dyes, pigments and mixtures thereof.

Suitable non-surfactant active materials include those materials that a formulator would employ at low levels and desire to deliver in a uniform manner. Useful non-surfactant actives include materials selected from the group consisting of oxidation catalysts, free radical initiators, bleach activators, enzymes, perfumes and mixtures thereof. Examples of oxidation catalysts include organic bleach catalysts such as 2-[3-[(2-ethylhexyl)oxy]-2-(sulfooxy)propyl]-3,4-dihydroisoquinolinium, inner salt and 3,4-dihydro-2-methylisoquinolinium, methanesulfonate; photobleachs such as phthalocyanines, for example zinc phthalocyanine tetrasulfonate; metal bleach catalysts such as dichloro-5,12-dimethyl-1,5,8,12-tetraazabicyclo[6.6.2]hexadecane Manganese(II) and [MnIV2(μ-O)3L'2]2+(L'=1,4,7-trimethyl-1,4,7-triazacyclononane); and mixtures thereof. Examples of free radical initiators include chemical, photo or thermal radical intiators, such as phenyl(2,4,6-trimethylbenzoyl)phosphinic acid, ethyl ester, and 2-hydroxy-2-methyl-1-[4-(1-methylethenyl) phenyl]-1-propanone homopolymer and mixtures thereof. Examples of bleach activators include nonanoic acid, 4-sulfophenyl ester, sodium salt, N,N,N',N'-tetraacetylethylenediamine and mixtures thereof. Examples of enzymes include hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. Examples of perfumes include aldehydes, such as 3-(4-t-butylphenyl)-2-methyl propanal, 3-(4-t-butylphenyl)-propanal, 3-(4-isopropylphenyl)-2-methylpropanal, 3-(3,4-methylenedioxyphenyl)-2-methylpropanal, and 2,6-dimethyl-5-heptenal; ketones, such as α-damascone, β-damascone, δ-damascone, β-damascenone, 6,7-dihydro-1,1,2,3,3-pentamethyl-4(5H)-indanone, methyl-7,3-dihydro-2H-1,5-benzodioxepine-3-one, 2-[2-(4-methyl-3-cyclohexenyl-1-yl) propyl]cyclopentan-2-one, 2-sec-butylcyclohexanone, and β-dihydro ionone; alcohols, such as linalool, ethyllinalool, tetrahydrolinalool, and dihydromyrcenol, and encapsulated perfumes as well as solid materials such as zeolites that are impregnated with perfume. Suitable non-surfactant actives can be made in accordance the examples contained in the present application or obtained from Firnenich of Geneva, Switzerland, Givaudan of Argenteuil, France, IFF of Hazlet, N.J. N.J. U.S.A., Quest of Mount Olive, N.J. U.S.A., Rhodia Inc. of Cranbury, N.J. U.S.A., Frontier Scientific, Inc. of Logan, Utah U.S.A., Fratelli Lamberti SpA, Italy, BASF AG of Ludwigshafen Germany, Genencor International, Inc., Palo Alto, Calif. U.S.A. and Novozymes A/S Denmark.

Suitable solid coating aids include materials selected from the group consisting of acetates, sulfates, carbonates, borates, phosphates and mixtures thereof. Examples of acetates include magnesium acetate, $Mg(CH_3COO)_2$; and sodium acetate, $NaCH_3COO$. Examples of sulfates include magnesium sulfate, $MgSO_4$; and sodium sulfate, $Na_2SO_4$. Examples of carbonates include sodium carbonate, $Na_2CO_3$; potassium carbonate, $K_2CO_3$. Examples of borates include sodium borate, $Na_2B_4O_7$. Examples of phosphates include sodium phosphate dibasic, $Na_2HPO_4$; and sodium tripolyphosphate, $Na_5P_3O_{10}$. Such coating aids may be introduced to the coating process as substantially anhydrous salts. While not being bound by theory, it is believed that their conversion to stable hydrate phases provides a mechanism for the removal of binder moisture and enables processing without the requirement of a drying step. Suitable solid coating aids can be obtained from PQ Corporation of Valley Forge, Pa., U.S.A.; FMC Corporation of Philadelphia, Pa., U.S.A.; and Mallinckrodt Baker, Inc. of Phillipsburg, N.J., U.S.A.

Suitable binders include materials selected from the group consisting of polymers, surfactants, solvents and mixtures thereof. Examples of polymers include sodium polyacrylate, acrylic-maleic co-polymers, polyethylene glycol, polyvinyl acetate, polyvinyl pyrrolidone, cellulose ethers, and hydroxypropyl cellulose. Examples of surfactants include anionic, cationic, zwitterionic and nonionic surfactants. Examples of solvents include water, alcohols, linear alcohols, branched alcohols, and fatty alcohols. Suitable binders can be obtained from BASF of Ludwigshafen, Germany; Dow Chemical Company of Midland, Mich., U.S.A.; Hercules Incorporated of Wilmington, Del., U.S.A.; Shell Chemical LP of Houston, Tex., U.S.A.; Procter & Gamble Chemicals of Cincinnati, Ohio, U.S.A.; and Rohm and Hass Company of Philadelphia, Pa., U.S.A.

Suitable core materials include detergent ingredients such as sodium sulfate, sodium carbonate and sodium phosphate as well as composite detergent ingredient compositions made by processes such as spray-drying, agglomeration, compaction or extrusion processes. Examples of such composite compositions include granules comprising detergent builder, surfactant and optionally polymer ingredients, as well as detergent ingredient compositions comprising nonanoic acid, 4-sulfophenyl ester, sodium salt and N,N,N',N'-tetraacetylethylenediamine. While suitable cores, such as detergent granules, are typically made as an intermediate within a detergent production facility, suitable cores and core raw materials can be obtained from FMC Corporation of Philadelphia, Pa., U.S.A.; Jost Chemicals of St. Louis, Mo., U.S.A.; and General Chemical Corporation of Parsippany, N.J., U.S.A.

Non-limiting examples of dyes and pigments include organic and inorganic pigments, aqueous and other solvent-soluble dyes. Such dyes and pigments can be obtained from Ciba Specialty Chemicals Corporation of Newport, Del., U.S.A.; Clariant Corporation of Charlotte, N.C., U.S.A.; and Milliken Chemical Company of Spartanburg, S.C., U.S.A.

Process of Making Non-Surfactant Active Containing Delivery Particles

The non-surfactant active containing delivery particle disclosed in the present application may be made via the teachings and examples disclosed herein. In one aspect of Applicants' invention, non-surfactant active containing delivery particles are made by combining a non-surfactant active component and a solid coating aid component to form a pre-mixture; and then coating at least a portion of a core material with a binder component and said pre-mixture to form a non-surfactant active containing delivery particle. In another aspect of Applicants' invention, non-surfactant active containing delivery particles are made by combining a non-surfactant active component and a binder component to form a pre-mixture; and then coating at least a portion of a core material with said pre-mixture and then a solid coating aid component to form a non-surfactant active containing delivery particle. In one aspect of Applicants' process, the binder component is uniformly distributed on the surface of the core material before the solid coating aid component is introduced. Regardless of which process is used, when the non-surfactant active component is a solid, such active is typically selected such that such active component and the solid coating aid component have similar particle sizes. Regardless of the process that is used, the starting materials have the required characteristics to permit a suitable non-surfactant active containing delivery particle to be formed via the process. Detailed characteristics for each of the following: non-surfactant active component, solid coating aid component, binder component and core material, as well as exemplary raw materials are disclosed in the present application under the heading Non-surfactant Active Containing Delivery Particle.

Applicants recognized that Stokes numbers can be used to define processing parameters for layering and agglomeration processes. As such, Applicants' processes may be conducted according to the following process parameters: Layering Stokes Number of less than 10, from about 0.001 to about 10 or even from about 0.001 to about 5, and a Core Agglomeration Stokes Number of greater than 0.5, from about 1 to about 1000 or even from about 2 to about 1000. The aforementioned Stokes numbers can be calculated as follows:

$$St_{mixer}=(0.0001)\cdot N\cdot R\cdot\rho\cdot\delta/\eta$$

The variables in the above equation are specified with units of measurement as follows:

- N is the rotational speed of the main agitation impeller shaft in the mixer (revolutions per minute, abbreviated as RPM)
- R in radial sweep distance of the main agitation impeller, from the center of the impeller shaft to the tip of the impeller tool (meters, abbreviated as m);
- $\rho$ is bulk density of the core particles (grams/liter, abbreviated as g/l);
- $\eta$ is binder viscosity (centipoises, abbreviated as cps); and
- $\delta$ is effective particle size used to describe layering or agglomeration (microns, abbreviated as um), where:
  - $\delta_{layering}$ is defined as $2\cdot(d_{core}\cdot d_{coating})/(d_{core}+d_{coating})$, and
  - $\delta_{core\text{-}agglomeration}$ is defined as $d_{core}$; where
    - $d_{core}$ is the median particle size of the core material, and
    - $d_{coating}$ is the median particle size of the solid coating aid material.

Based on the above, two sub-forms of the Stokes equation can be defined, one to describe the layering of the coating aid onto the core particles ($St_{layering}$), and another to describe the agglomeration of core particles with other cores ($St_{core\text{-}agglomeration}$).

Layering Stokes Number, $St_{layering}=(0.0001)\cdot N\cdot R\cdot\rho\cdot\delta_{layering}/\eta$ Core-Agglomeration Stokes Number= $St_{core\text{-}agglomeration}=(0.0001)\cdot N\cdot R\cdot\rho\cdot\delta_{core\text{-}agglomeration}/\eta$ Suitable equipment for performing the processes disclosed herein includes paddle mixers, ploughshare mixers, ribbon blenders, vertical axis granulators and drum mixers, both in batch and, where available, in continuous process configurations. Such equipment can be obtained from Lodige GmbH (Paderbom, Germany), Littleford Day, Inc. (Florence, Ky., U.S.A.), Forberg AS (Larvik, Norway), Glatt Ingenieurtechnik GmbH (Weimar, Germany).

Cleaning Compositions Comprising Non-surfactant Active Containing Delivery Particles The cleaning compositions of the present invention comprise an embodiment of the non-surfactant active containing delivery particle disclosed in the present application. While the precise level of non-surfactant active containing delivery particle that is employed depends on the type and end use of the cleaning composition, in one aspect of Applicants' invention, the cleaning composition comprises, based on total cleaning composition weight, no more than 15, 10 or even 5 weight percent of any single non-surfactant active containing delivery particle. In one aspect of Applicants' invention, the cleaning composition comprises no more than 2, 0.5 or even 0.2 weight percent of any single non-surfactant active that is delivered to said cleaning composition by said non-surfactant active containing delivery particle. In another aspect of Applicants' invention, the median particle size of the non-surfactant active containing delivery particle typically falls between the fifteen and ninety-fifth percentile, fifteen and eighty-fifth percentile or even thirtieth and seventieth percentile of the cleaning composition's mass based cumulative particle size distribution.

The cleaning compositions disclosed herein are typically formulated such that, during use in aqueous cleaning operations, the wash water will have a pH of between about 6.5 and about 12, or between about 7.5 and 10.5. Liquid dishwashing product formulations typically have a pH between about 6.8 and about 9.0. Cleaning products are typically formulated to have a pH of from about 7 to about 12. Techniques for controlling pH at recommended usage levels include the use of buffers, alkalis, acids, etc., and are well known to those skilled in the art.

Adjunct Materials

While not essential for the purposes of the present invention, the non-limiting list of adjuncts illustrated hereinafter are suitable for use in the instant cleaning compositions and may be desirably incorporated in certain embodiments of the invention, for example to assist or enhance cleaning performance, for treatment of the substrate to be cleaned, or to modify the aesthetics of the cleaning composition as is the case with perfumes, colorants, dyes or the like. It is understood that such adjuncts are in addition to the components that are supplied via Applicants' delivery particles. The precise nature of these additional components, and levels of incorporation thereof, will depend on the physical form of the composition and the nature of the cleaning operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282, 6,306,812 B1 and 6,326,348 B1 that are incorporated by reference.

Surfactants—Preferably, the cleaning compositions according to the present invention comprise a surfactant or surfactant system wherein the surfactant can be selected from nonionic and/or anionic and/or cationic surfactants and/or ampholytic and/or zwitterionic and/or semi-polar nonionic surfactants.

The surfactant is typically present at a level of from about 0.1%, preferably about 1%, more preferably about 5% by weight of the cleaning compositions to about 99.9%, preferably about 80%, more preferably about 35%, most preferably about 30% by weight of the cleaning compositions.

Builders—The cleaning compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

Builders include, but are not limited to, the alkali metal, ammonium and alkanolammonium salts of polyphosphates, alkali metal silicates, alkaline earth and alkali metal carbonates, aluminosilicate builders polycarboxylate compounds. ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The cleaning compositions herein may also optionally contain one or more copper, iron and/or manganese chelating agents.

If utilized, these chelating agents will generally comprise from about 0.1% by weight of the cleaning compositions herein to about 15%, more preferably 3.0% by weight of the cleaning compositions herein.

Dye Transfer Inhibiting Agents—The cleaning compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

When present in the cleaning compositions herein, the dye transfer inhibiting agents are present at levels from about 0.0001%, more preferably about 0.01%, most preferably about 0.05% by weight of the cleaning compositions to about 10%, more preferably about 2%, most preferably about 1% by weight of the cleaning compositions.

Dispersants—The cleaning compositions of the present invention can also contain dispersants. Suitable water-soluble organic materials are the homo- or co-polymeric acids or their salts, in which the polycarboxylic acid comprises at least two carboxyl radicals separated from each other by not more than two carbon atoms.

Enzymes—The cleaning compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is cocktail of conventional applicable enzymes like protease, lipase, cutinase and/or cellulase in conjunction with amylase.

Enzyme Stabilizers—Enzymes for use in detergents can be stabilized by various techniques. The enzymes employed herein can be stabilized by the presence of water-soluble sources of calcium and/or magnesium ions in the finished compositions that provide such ions to the enzymes.

Catalytic Metal Complexes—Applicants' cleaning compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

If desired, the compositions herein can be catalyzed by means of a manganese compound. Such compounds and levels of use are well known in the art and include, for example, the manganese-based catalysts disclosed in U.S. Pat. No. 5,576,282 Miracle et al.

Cobalt bleach catalysts useful herein are known, and are described, for example, in U.S. Pat. No. 5,597,936 Perkins et al., issued Jan. 28, 1997; U.S. Pat. No. 5,595,967 Miracle et al., Jan. 21, 1997. Such cobalt catalysts are readily prepared by known procedures, such as taught for example in U.S. Pat. Nos. 5,597,936, and 5,595,967.

Compositions herein may also suitably include a transition metal complex of a macropolycyclic rigid ligand—abreviated as "MRL". As a practical matter, and not by way of limitation, the compositions and cleaning processes herein can be adjusted to provide on the order of at least one part per hundred million of the active MRL species in the aqueous washing medium, and will preferably provide from about 0.005 ppm to about 25 ppm, more preferably from about 0.05 ppm to about 10 ppm, and most preferably from about 0.1 ppm to about 5 ppm, of the MRL in the wash liquor.

Preferred transition-metals in the instant transition-metal bleach catalyst include manganese, iron and chromium. Preferred MRL's herein are a special type of ultra-rigid ligand that is cross-bridged such as 5,12-diethyl-1,5,8,12-tetraazabicyclo[6.6.2]hexadecane.

Suitable transition metal MRLs are readily prepared by known procedures, such as taught for example in WO 00/332601, and U.S. Pat. No. 6,225,464.

Processes of Making and Using Cleaning Compositions

The cleaning compositions of the present invention can be formulated into any suitable form and prepared by any process chosen by the formulator, non-limiting examples of which are described in U.S. Pat. No. 5,879,584 Bianchetti et al., issued Mar. 9, 1999; U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

Method of Use

The cleaning compositions containing the non-surfactant active containing delivery particle disclosed herein of can be used to clean a situs inter alia a surface or fabric. Typically at least a portion of the situs is contacted with an embodiment of Applicants' cleaning composition, in neat form or diluted in a wash liquor, and then the situs is washed and/or rinsed. For purposes of the present invention, washing includes but is not limited to, scrubbing, and mechanical agitation. The fabric may comprise most any fabric capable of being laundered in normal consumer use conditions. Cleaning solutions that comprise the disclosed cleaning compositions may have a pH of from about 8 to about 10.5. Such compositions are typically employed at concentrations of from about 500 ppm to about 15,000 ppm in solution. When the wash solvent is water, the water temperature typically ranges from about 5° C. to about 90° C. and, when the situs comprises a fabric, the water to fabric mass ratio is typically from about 1:1 to about 30:1.

Test Methods

It is understood that the test methods that are disclosed in the Test Methods Section of the present application must be used to determine the respective values of the parameters of Applicants' inventions as such inventions are described and claimed herein.

1.) Non-surfactant Active Particle Relative Standard Deviation Distribution Test a.) Obtain a representative 10 gram sample of the non-surfactant active containing active delivery particle. If samples are taken from a bulk container, use a representative sampling, for example as per ISO 9138, "Abrasive grains—Sampling and splitting," published February 1993.

b.) Divide the aforementioned sample into (10) ten (1) one gram samples using a suitable Jones Type Riffler sample splitter as per ISO 9138, or preferably a spinning riffler such as a Microscal™ Spinning Riffler model SR1A supplied by Microscal Limited 79 Southern Row London W10 5AL, United Kingdom.

c.) Determine the level of each non-surfactant active in each of the (1) one gram samples using a test method that provides an accuracy of at least ±5%. An example of a test method that is suitable for the oxidation catalyst 2-[3-[(2-ethylhexyl)oxy]-2-(sulfooxy)propyl]-3,4-dihydro-isoquinolinium, inner salt is detailed below:

(i) Principle: One (1) gram samples of non-surfactant active containing delivery particle containing 2-[3-[(2-ethylhexyl)oxy]-2-(sulfooxy)propyl]-3,4-dihydro-isoquinolinium, inner salt are dissolved in a 50:50 solution of acetonitrile:water and quantitated with UV detection at 290 nm, vs. an external standard calibration curve prepared from a known activity standard.

(ii) Apparatus: HP/Agilent 1100 solvent delivery system equipped with a PDA detector, a HP ChemStation data collection integration system, a Phenomenex Columbus (C18 100 mm×2.0 mm) reverse phase column, and sample filtration units (0.45 micron PTFE Acrodisc CR disc filter).

(iii) Reagents And Solutions

| | |
|---|---|
| Organic catalyst standard powder | For generation of calibration curves |
| 1:1 HPLC Water:HPLC Acetonitrile | Solvent for sample prep |
| Formic Acid | Eluent D (5% aqueous solution) |
| HPLC Acetonitrile | Eluent C |
| HPLC Water | Eluent A |

Preparation of Standard Stock Solutions

Prepare a stock solution of approximately 1000 ug/ml of 2-[3-[(2-thylhexyl)oxy]-2-(sulfooxy)propyl]-3,4-dihydro-isoquinolinium, inner salt standard in a 50/50 mix of acetonitrile/water by adding approximately 25 mg of the standard to a 25 ml volumetric and diluting to volume. Sonicate for 10 minutes following by stirring for 20 minutes Preparation of Calibration Solution Prepare solutions of approximately 10, 5, and 2.5 ug/ml of the standard in a 50/50 mix of acetonitrile/water by taking 1.0, 0.5, and 0.25 ml of the standard stock solution and diluting each up to volume in a 10 ml volumetric. Mix thoroughly.

Sample Analysis

In separate 50 ml volumetric flasks, prepare ten 50 ml solutions each containing approximately 1 gram of non-surfactant active containing delivery particle containing 2-[3-[(2-ethylhexyl)oxy]-2-(sulfooxy)propyl]-3,4-dihydro-isoquinolinium, inner salt in a 50/50 mix of acetonitrile/water. Sonicate for 10minutes and then stir for 20 minutes. Take a 1 ml aliquot from each 50 ml solution and dilute 10:1 in a 10 ml volumetric with 50/50 acetonitrile/water. The concentration of 2-[3-[(2-ethylhexyl)oxy]-2-(sulfooxy)propyl]-3,4-dihydro-isoquinolinium, inner salt must fall within the 25-100 ppm range of the calibration curve.

Instrument Operation:

Injection Volume: 5 ul Solvents: A=$H_2O$, C=Acetonitrile, D=5% Formic Acid,

Analytical wavelength @ 290 nm. Keep the absorbance units (AU) below 1 AU

Solvent System Gradient Profile

| Total Time (min) | Flow Rate (μl/min) | A (%) | B (%) | C (%) | D (%) |
|---|---|---|---|---|---|
| 0 | 330 | 60 | 0 | 30 | 10 |
| 5 | 380 | 50 | 0 | 40 | 10 |
| 10 | 480 | 30 | 0 | 60 | 10 |
| 15 | 530 | 5 | 0 | 90 | 5 |
| 25 | 530 | 5 | 0 | 90 | 5 |
| 26 | 530 | 60 | 0 | 30 | 10 |
| 37 | 530 | 60 | 0 | 30 | 10 |
| 38 | 330 | 60 | 0 | 30 | 10 |

(v) Calculations: The peak areas from the calibration injections are used to determine the response factor and thus weight percent of 2-[3-[(2-ethylhexyl)oxy]-2-(sulfooxy)propyl]-3,4-dihydro-isoquinolinium, inner salt in each 1 gram sample d.) For each non-surfactant active identified, use the measured weight percent of non-surfactant active found in each 1 gram sample (Step c) to calculate the relative standard deviation for each such non-surfactant active. For the purposes of the present invention, such relative standard deviation is considered to be the non-surfactant active particle relative standard deviation for the specific active that is tested.

2.) Solid Coating Aid Component Median Particle Size Test

This test method must be used to determine a solid coating aid component's median particle size. The solid coating aid component particle size test is determined in accordance with ISO 8130-13, "Coating powders—Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; and Beckman-Coulter Incorporated of Fullerton, Calif., U.S.A.

The results are expressed in accordance with ISO 9276-1: 1998, "Representation of results of particle size analysis—Part 1: Graphical Representation", Figure A.4,"Cumulative distribution $Q_3$ plotted on graph paper with a logarithmic abscissa." The median particle size is defined as the abscissa value at the point where the cumulative distribution ($Q_3$) is equal to 50 percent.

3.) Binder Component Viscosity Test

This test method must be used to determine binder component viscosity. For binder component viscosities in excess of about 100 cps, the viscosity is determined in accordance with ISO 2555, second edition published Feb. 1, 1989and reprinted with corrections Feb, 1, 1990, "Plastics—resins in the liquid state or as emulsions or dispersions—Determination of apparent viscosity by the Brookfield Test method." As described in the method, a viscometer of type "A" is applicable to the range of viscosity cited in the current work. The viscosity measurement is performed at the same binder component temperature at which the binder component is introduced into the process used to make the subject non-surfactant active containing delivery particle.

For viscosities below about 100 cps, the viscosity is determined in accordance with ASTM D2857-95, "Standard Practice for Dilute Solution Viscosity of Polymers," published April 1995. The viscosity measurement is performed at the same binder component temperature at which the binder component is introduced into the process used to make the subject non-surfactant active containing delivery particle.

4.) Core Material Median Particle Size and Distribution Span Test

This test method must be used to determine core material median particle size. The core material particle size test is conducted to determine the median particle size of the core material using a ASTM D 502-89, "Standard Test Method for Particle Size of Soaps and Other Detergents", approved May 26, 1989, with a further specification for sieve sizes used in the analysis. Following section 7, "Procedure using machine-sieving method," a nest of clean dry sieves containing U.S. Standard (ASTM E 11) sieves #12 (1700 um), #18 (1000 um), #20 (850 um), #30 (600 um), #40 (425 um), #50 (300 um), #70 (212 um), #100 (150 um) is required. The prescribed Machine-Sieving Method is used with the above sieve nest. The core material is used as the sample. A suitable sieve-shaking machine can be obtained from W. S. Tyler Company of Mentor, Ohio, U.S.A.

The cumulative percent material data are plotted against the micron opening size of each sieve, where the micron size openings are represented on the abscissa using a log-scale and the cumulative mass percent data are represented on the ordinate using a linear scale. The data points on the semi-log plot are connected by straight line segments. The core material median particle size is defined as the abscissa value at the point where the cumulative mass percent is equal to 50 percent.

An example of the above data representation is given in ISO 9276-1:1998,"Representation of results of particle size analysis—Part 1: Graphical Representation", Figure A.4. Note the current sieve-shaking method specifies straight line segments for interpolation between the data points. In the event that the $50^{th}$ percentile value falls below the finest sieve size (150 um) or above the coarsest sieve size (1700 um), then additional sieves must be added to the nest following a geometric progression of not greater than 1.5, until the median falls between two measured sieve sizes.

The Distribution Span of the Core Material is a measure of the breadth of the core size distribution about the median. It is calculated according to the following:

$$\text{Span}=[(D84/D50)+(D50/D16)]/2$$

Where D84 and D16 are the particle sizes at the sixteenth and eighty-fourth percentiles on the cumulative mass percent plot, respectively.

In the event that the D16 value falls below the finest sieve size (150 um), then the span is calculated according to the following:

$$\text{Span}=(D84/D50)$$

Where D50 is the median particle size.

In the event that the D84 value falls above the coarsest sieve size (1700 um), then the span is calculated according to the following:

$$\text{Span}=(D50/D16)$$

In the event that the D16 value falls below the finest sieve size (150 um) and the D84 value falls above the coarsest sieve size (1700 um), then the span is taken to be a maximum value of 5.7.

5.) Core Material Bulk Density Test

The core material bulk density is determined in accordance with Test Method B, Loose-fill Density of Granular Materials, contained in ASTM Standard E727-02,"Standard Test Methods for Determining Bulk Density of Granular Carriers and Granular Pesticides," approved Oct. 10, 2002.

6.) Non-surfactant Active Containing Delivery Particle/Cleaning Composition's Mass Based Cumulative Particle Size Distribution Test This test method must be used to determine if the median particle size of the non-surfactant active containing delivery particle falls within the claimed percentile of a cleaning composition's mass based cumulative particle size distribution. This test follows the same procedure that is specified for the "Core Material Median Particle Size Test" described above except that the method is used to measure:

a) the median particle size of the non-surfactant active containing delivery particle, and b) selected percentile size values of the cleaning composition.

In part (a), the "Core Material Median Particle Size Test" is performed using the non-surfactant active containing delivery particle as the sample instead of the core material. The median particle size is calculated in the same manner.

In part (b), the "Core Material Median Particle Size Test" is performed using the full cleaning composition including representative weight fractions of all admix components in the full composition except for the non-surfactant active containing delivery particle. The cumulative percent material data are plotted against the micron opening size of each sieve, where the micron size opening of each sieve is plotted against the abscissa using a log-scale and the cumulative mass percent is plotted against the ordinate using a linear scale. The data points on the semi-log plot are connected by straight line segments. The particle sizes at the fifteenth, thirtieth, seventieth, eighty-fifth and ninety-fifth percentiles are determined according abscissa values at the points where the cumulative mass percent is equal to 15%, 30%, 70%, 85% and 95%, respectively. In the event that the any of the aforementioned percentile values fall below the finest sieve size (150 um) or above the coarsest sieve size (1700 um), then additional sieves must be added to the nest following a geometric progression of not greater than 1.5, until the percentile in question falls between two measured sieve sizes.

EXAMPLES

Example 1

Preparation of Sulfuric Acid Mono-[2-(3,4-dihydro-isoquinolin-2-yl)-1-(2-ethyl-hexyloxymethyl)-ethyl] ester, Internal Salt To a flame dried 250 ml three neck round bottomed flask, equipped with an addition funnel, dry argon inlet, magnetic stir bar, thermometer, and cooling bath is added 3,4-dihydroisoquinoline (5.0 gm, 0.038 mol.) and acetonitrile (50 ml). To the addition funnel is added methylene chloride (10 ml) and neat sulfuric anhydride ($SO_3$) (3.05 gm, 0.038mol). The reaction vessel is placed in an ice bath and contents cooled to 5° C. To the reaction solution is added dropwise the $SO_3$/$CH_2Cl_2$ solution over 30 minutes keeping the temperature below 10° C. A white precipitate forms upon addition of the sulfuric anhydride. Once addition is complete the reaction is allowed to warm to room temperature and the white suspension stirred for 1 hour under argon. To the reaction is added 2-ethylhexyl glycidal ether (7.1 gm, 0.038 mol) and the reaction is placed in a 90° C. oil bath. The methylene chloride is removed via Dean Stark Trap and once removed an internal reaction temperature of 75-80° C. is obtained, upon which the reaction turns clear/amber. The reaction is stirred at 75-80° C. for 72 hours. The reaction is then cooled to room temperature, evaporated to dryness and the tan residue recrystallized from isopropanol, to yield the desired product, 10.3 gm (68%), 19 wt. % of the final reaction mixture. Raw materials can be obtained from Aldrich of Milwaukee, Wis. U.S.A. and BASF AG of Ludwigshafen, Germany.

Example 2

Formulation of Non-surfactant Active Containing Delivery Particles and Cleaning Compositions Comprising Same Non-surfactant active containing delivery particles having the following formulae are prepared in accordance with the teachings disclosed in the present application.

| | D1 | D2 | D3 | D4 | D5 | D6 | D7 | D8 |
|---|---|---|---|---|---|---|---|---|
| Non-surfactant actives: | | | | | | | | |
| Organic Catalyst* | 1.50 | 1.50 | 1.50 | 1.50 | 2.00 | 4.00 | 5.00 | 10.00 |
| Core & Material: | | | | | | | | |
| Detergent granules: | | | | | | | | |
| Sodium alkylbenzenesulfonate | 0.00 | 0.00 | 0.00 | 0.00 | 0.00 | 0.00 | 15.00 | 10.00 |
| Sodium alkylsulfate | 26.68 | 0.00 | 0.00 | 0.00 | 0.00 | 0.00 | 0.00 | 10.00 |
| Polyethylene glycol | 1.84 | 1.00 | 0.00 | 0.00 | 0.00 | 0.00 | 2.00 | 0.00 |
| Sodium polyacrylate | 0.00 | 0.00 | 0.00 | 0.00 | 0.00 | 0.00 | 4.00 | 0.00 |
| Sodium carbonate | 0.00 | 0.00 | 0.00 | 0.00 | 0.00 | 0.00 | 25.00 | 28.00 |
| Sodium aluminosilicate hydrate | 63.48 | 72.80 | 0.00 | 0.00 | 0.00 | 0.00 | 0.00 | 32.00 |
| Sodium tripolyphosphate | 0.00 | 0.00 | 0.00 | 0.00 | 0.00 | 0.00 | 8.00 | 0.00 |
| Sodium diethylenetriaminepentaacetate | 0.00 | 16.20 | 0.00 | 0.00 | 0.00 | 0.00 | 0.00 | 0.00 |
| Sodium sulfate | 0.00 | 0.00 | 0.00 | 0.00 | 0.00 | 0.00 | 30.00 | 0.00 |
| Sodium silicate | 0.00 | 0.00 | 0.00 | 0.00 | 0.00 | 0.00 | 3.50 | 0.00 |
| Granular core materials: | | | | | | | | |
| Sodium sulfate | 0.00 | 0.00 | 0.00 | 0.00 | 92.50 | 0.00 | 0.00 | 0.00 |
| Sodium carbonate | 0.00 | 0.00 | 92.50 | 0.00 | 0.00 | 0.00 | 0.00 | 0.00 |
| Sodium tripolyphosphate | 0.00 | 0.00 | 0.00 | 90.00 | 0.00 | 0.00 | 0.00 | 0.00 |
| Coated sodium percarbonate | 0.00 | 0.00 | 0.00 | 0.00 | 0.00 | 85.00 | 0.00 | 0.00 |
| Binders: | | | | | | | | |
| Water | 1.60 | 1.50 | 2.00 | 2.00 | 2.00 | 0.00 | 2.00 | 3.00 |
| Sodium polyacrylate | 0.40 | 0.00 | 0.00 | 0.50 | 0.50 | 0.00 | 0.00 | 0.00 |
| Acrylic-maleic co-polymer | 0.00 | 0.00 | 0.00 | 0.00 | 0.00 | 0.00 | 0.50 | 0.00 |
| Polyethylene glycol | 0.00 | 0.50 | 0.00 | 0.00 | 0.00 | 0.00 | 0.00 | 0.50 |
| Zwitterionic polymer | 0.00 | 0.00 | 0.00 | 0.00 | 0.00 | 0.00 | 0.00 | 0.50 |
| Nonionic surfactant | 0.00 | 1.50 | 0.00 | 1.00 | 0.00 | 0.00 | 0.00 | 0.00 |
| Anionic surfactant | 0.00 | 0.00 | 1.00 | 0.00 | 0.00 | 0.00 | 0.00 | 0.00 |
| Fatty alcohol | 2.00 | 0.00 | 0.00 | 1.00 | 0.00 | 3.00 | 0.00 | 0.00 |
| Nonionic wax emulsion | 0.00 | 0.00 | 0.00 | 0.00 | 0.00 | 2.00 | 0.00 | 0.00 |
| Solid coating aids: | | | | | | | | |
| Magnesium sulfate | 2.50 | 4.50 | 0.00 | 4.00 | 3.00 | 6.00 | 4.00 | 1.00 |
| Sodium carbonate | 0.00 | 0.00 | 3.00 | 0.00 | 0.00 | 0.00 | 0.00 | 0.00 |
| Sodium borate | 0.00 | 0.00 | 0.00 | 0.00 | 0.00 | 0.00 | 0.00 | 5.00 |
| Magnesium acetate | 0.00 | 0.50 | 0.00 | 0.00 | 0.00 | 0.00 | 1.00 | 0.00 |

Total Delivery Particle = 100.00:

*Sulfuric acid mono-[2-(3,4-dihydro-isoquinolin-2-yl)-1-(2-ethyl-hexyloxymethyl)-ethyl] ester, internal salt prepared according to Example 1 or other non-surfactant active.

Cleaning compositions having the following formulae are prepared in accordance with the teachings disclosed in the present application.

| | Formulation Examples: | | | | | | | |
|---|---|---|---|---|---|---|---|---|
| | F1 | F2 | F3 | F4 | F5 | F6 | F7 | F8 |
| Delivery particle type: | D5 | D1 | D6 | D8 | D1 | D2 | D3 | D4 |
| Delivery particle parts: | 2.50 | 3.00 | 4.00 | 1.00 | 3.32 | 4.80 | 3.33 | 3.33 |
| Formulation balance: | | | | | | | | |
| Sodium alkylbenzenesulfonate | 19.99 | 6.10 | 8.19 | 8.48 | 0.07 | 3.41 | 17.45 | 17.45 |
| Sodium alkylsulfate | 1.16 | 12.20 | 5.13 | 6.08 | 15.27 | 13.71 | 0.00 | 0.00 |
| Ethoxylated sodium alkylsulfate | 0.29 | 0.00 | 0.00 | 0.00 | 0.00 | 0.00 | 1.55 | 1.55 |
| Sodium Percarbonate | 6.16 | 6.16 | 0.00 | 3.49 | 2.78 | 4.50 | 11.67 | 3.21 |
| Nonanoyloxybenzenesulfonate | 4.75 | 4.75 | 2.10 | 2.41 | 1.92 | 5.16 | 0.00 | 0.00 |
| Tetraacetylethylenediamine | 0.00 | 0.00 | 0.00 | 0.00 | 0.00 | 0.00 | 2.10 | 2.10 |
| Sodium aluminosilicate hydrate | 13.84 | 12.96 | 25.38 | 27.98 | 32.46 | 32.46 | 14.36 | 12.80 |
| Acrylic/Maleic Acids Copolymer | 6.35 | 3.36 | 0.00 | 0.00 | 0.00 | 0.00 | 2.30 | 2.30 |
| Sodium Polyacrylate | 0.00 | 0.00 | 1.51 | 1.53 | 1.74 | 1.18 | 0.00 | 0.00 |
| Sodium Carbonate | 19.55 | 22.25 | 22.48 | 21.47 | 24.11 | 23.33 | 20.60 | 20.60 |
| Sodium Tripolyphosphate | 0.00 | 0.00 | 0.00 | 0.00 | 0.00 | 0.00 | 0.00 | 12.40 |
| Sodium Silicate | 2.43 | 2.47 | 0.00 | 0.00 | 0.00 | 0.00 | 0.00 | 0.00 |
| Sodium diethylenetriaminepentaacetate | 0.00 | 0.00 | 0.72 | 0.80 | 0.72 | 0.54 | 0.54 | 0.54 |
| Brightener 15 | 0.17 | 0.17 | 0.00 | 0.11 | 0.08 | 0.12 | 0.12 | 0.12 |
| Brightener 49 | 0.09 | 0.09 | 0.00 | 0.00 | 0.00 | 0.00 | 0.00 | 0.00 |
| Sodium Xylene Sulfonate | 1.81 | 0.00 | 0.00 | 0.00 | 0.00 | 0.00 | 0.00 | 0.00 |
| Polydimethylsiloxane | 0.06 | 0.06 | 0.02 | 0.02 | 0.02 | 0.04 | 0.04 | 0.04 |
| Ethyl Methyl Cellulose | 0.00 | 0.00 | 1.11 | 0.00 | 1.11 | 0.00 | 0.00 | 0.00 |
| Imideazole Epichlorohydrin | 0.00 | 0.00 | 0.15 | 0.00 | 0.15 | 0.00 | 0.00 | 0.00 |
| Savinase active enzyme | 0.054 | 0.054 | 0.015 | 0.010 | 0.015 | 0.021 | 0.021 | 0.021 |
| Carezyme active enzyme | 0.000 | 0.000 | 0.003 | 0.000 | 0.000 | 0.000 | 0.000 | 0.000 |
| Perfume | 0.21 | 0.21 | 0.22 | 0.26 | 0.38 | 0.24 | 0.24 | 0.24 |
| Balance sodium sulfate | | | | | | | | |

Total formulation = 100.00

Example 3

Process For Making Non-surfactant Active Containing Delivery Particles

This process is practiced in a food processor (mixer), with a vertical axis-driven impeller having a radial sweep of 7.5 cm.

A powdered non-surfactant active is blended with a magnesium sulfate powder grade, having a median particle size of about 10 um, in a ratio of 40 parts of non-surfactant active to 60 parts magnesium sulfate powder, to produce a fine powder mixture. To improve uniformity of the blend, the mixture is passed through a micronizing mill. The core material is granular sodium sulfate having a median particle size of 664 um, a distribution span of about 1.2 and a bulk density of about 1500 g/l. Nine hundred twenty five grams of the core material are loaded into the mixer. The mixer is started, using a rotational speed of about 500 RPM. Fifteen grams of a polymer binder solution (about 22% sodium polyacrylate aqueous solution) is added to the mixer by drop-wise addition from a syringe, where the syringe is positioned so as to contact the droplets onto the surface of the moving particles in the mixer, avoiding overlap of droplets. The mixer is stopped, fifty grams of the premixed blend of the solid coating aid and cleaning active are added on top of the wetted cores, and then the mixer is re-started at about 500 RPM. For a binder viscosity of 40 cps, these conditions result in a Layering Stokes Number of about 4 and a Core Agglomeration Stokes Number of about 90. After a mixing time of about one minute, an additional ten grams of binder solution is added to the mixer in the same drop-wise fashion, and mixing continues for another 30 seconds. The batch is unloaded into a metal tray that is used to radiate any heat of hydration from the reaction of the coating aid with the aqueous fraction of the binder. The resulting product is found to have a non-surfactant active particle relative standard deviation of less than 5% and a median particle size of 704 um. This corresponds to an average particle coating thickness of about 20 um.

Example 4

Process For Making Non-surfactant Active Containing Delivery Particles

This process is practiced in a food processor (mixer), with a vertical axis-driven impeller having a radial sweep of 7.5 cm.

A powdered non-surfactant active and a binder component are blended in a ratio of 30 parts of the non-surfactant active to 70 parts of binder component to form a paste. Said binder component comprises fatty alcohols having a carbon chain length from 12 to 18. The core material is a spray-dried detergent granule having a median particle size of 520 um, a distribution span of 1.35, and a bulk density of about 480 g/l. Three hundred sixty grams of the core material are loaded into the mixer. The mixer is started, using a rotational speed of about 1000 RPM. Twenty grams of the non-surfactant active and binder component premix are added to the mixer by drop-wise addition from a syringe. The mixer is stopped, fifteen grams of magnesium sulfate with a median particle size of about 10 um is added on top of the wetted cores. The mixer is re-started at about 1000RPM. For a binder component viscosity of about 200 cps, these conditions result in a Layering Stokes Number of about 0.35 and a Core Agglomeration Stokes Number of about 9. After a mixing time of about one minute, an additional five grams of aqueous sodium polyacrylate solution having about 22% solids is added to the mixer in the same drop-wise fashion. After continued mixing for about 30 seconds, the batch is unloaded into a metal tray that is used to radiate any heat of hydration from the reaction of the coating aid with the aqueous fraction of the binder. The resulting product is found to have a non-surfactant active particle relative standard deviation of less than 10% and a median particle size of about 550 um.

Example 5

Process For Making Non-surfactant Active Containing Delivery Particles

This process is practiced using a ploughshare batch mixer, Lodige M20, with a set of ploughshare agitation impellers driven by a horizontal shaft. The radial sweep of the agitation impellers is 14.5 cm. The high-speed chopper is not used unless otherwise specified.

A powdered non-surfactant active is blended with a magnesium sulfate powder grade, having a median particle size of about 10 um, in a ratio of 30 parts of non-surfactant active to 60 parts magnesium sulfate powder, to produce a fine powder premixture. To improve uniformity of the blend, the mixture is passed through a micronizing mill.

The core material is a compact detergent agglomerate particle consisting of a composite of detergent builder and surfactant having a median particle size of 500 um, a distribution span of 1.3, and a bulk density of about 800 g/l. Five kilograms of the core material are loaded into the mixer. The mixer is started, using a rotational speed of about 150 RPM. One hundred grams of binder component comprising a 30% solids aqueous solution of polyethylene glycol (MW about 4,000), is sprayed into the mixer using a pressure atomizer at a rate of about 5 grams/s. The mixer is stopped and 270 grams of the premix are added on top of the wetted core material, and then the mixer is re-started at about 150RPM. At this point, the chopper is turned on briefly to help disperse the coating aid powder with the moist cores. After about 10 seconds of chopper operation, it is turned off. For a binder component viscosity of about 20 cps, these conditions result in a Layering Stokes Number of about 1.7 and a Core Agglomeration Stokes Number of about 44. After a mixing time of about one minute, an additional fifty grams of binder component is sprayed into the mixer using a pressure atomizer, and mixing continues for another 30 seconds. The mixer jacket may be cooled with chilled water in order to remove any heat from the hydration of the solid coating aid with moisture in the binder solution. The resulting product is found to have a non-surfactant active particle relative standard deviation of less than 20% and a median particle size of 525 um.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning composition comprising a non-surfactant active containing delivery particle comprising:

a.) a first coating comprising;

(i) a non-surfactant active component, said non-surfactant active component being sufficiently evenly dispersed in said coating to provide a non-surfactant active particle relative standard deviation of less than or equal to 20%;

(ii) a solid coating aid component having a median particle size of less than 50 microns, said solid coating aid comprising a material selected from the group consisting of acetates, sulfates, carbonates, borates, phosphates and mixtures thereof; and (iii) a binder component, said binder component having a viscosity of less than about 4,000 cps;

b.) a core material having a median particle size of at least 150 microns and a distribution span from 1 to about 2, at least a portion of said core material being coated by said first coating; and c.) optionally, at least one additional coating.

2. A cleaning composition according to claim 1 wherein said cleaning composition comprises, based on total cleaning composition weight, no more than 15 weight percent of any single species of non-surfactant active containing delivery particle.

3. A cleaning composition according to claim 2, said cleaning composition comprising, based on total cleaning composition weight, no more than 2 weight percent of any singe species of non-surfactant active that is delivered to said cleaning composition by said non-surfactant active containing delivery particle.

4. A cleaning composition according to claim 1, wherein the median particle size of the non-surfactant active containing delivery particle falls between the fifteen and ninety-fifth percentile of the cleaning composition's mass based cumulative particle size distribution.

5. A cleaning composition according to claim 4, wherein the median particle size of the non-surfactant active containing delivery particle falls between the fifteen and eighty-fifth percentile of the cleaning composition's mass based cumulative particle size distribution.

6. A cleaning composition according to claim 1 wherein said non-surfactant active containing delivery particle's non-surfactant active component is sufficiently evenly dispersed in said first coating to provide a non-surfactant active particle relative standard deviation of less than or equal to 10%.

7. A cleaning composition according to claim 6 wherein said non-surfactant active containing delivery particle's non-surfactant active component is sufficiently evenly dispersed in said first coating to provide a non-surfactant active particle relative standard deviation of less than or equal to 5%.

8. A cleaning composition according to claim 1 wherein, said non-surfactant active component comprises a non-surfactant active selected from the group consisting of oxidation catalysts, free radical initiators, bleach activators, enzymes, perfumes and mixtures thereof; said binder component comprises a binder selected from the group consisting of polymers, surfactants, solvents and mixtures thereof; and said core material's median particle size is from 150 microns to about 1000 microns.

9. A cleaning composition according to claim 8, wherein said non-surfactant active containing delivery particle comprises, based on total particle weight, no more than 20 weight percent of any single non-surfactant active and no more than 10 weight percent of said binder component.

10. A cleaning composition according to claim 1 wherein said non-surfactant active containing delivery particle comprises said at least one additional coating.

11. A cleaning composition according to claim 1 wherein said non-surfactant active containing delivery particle further comprises a material selected from dyes, pigments and mixtures thereof.

12. A cleaning composition according to claim 1 wherein said non-surfactant active containing delivery particle has a core material median particle size to solid coating aid component median particle size ratio of at least 10:1.

13. A cleaning composition according to claim 1 wherein said non-surfactant active containing delivery particle has a core material bulk density of at least 300 grams per liter.

14. A cleaning composition comprising a non-surfactant active containing delivery particle comprising:

a.) a first coating comprising;

(i) a non-surfactant active component, said non-surfactant active component comprising a material selected from the group consisting of oxidation catalysts, free radical initiators, bleach activators, perfumes and mixtures thereof, and being sufficiently evenly dispersed in said coating to provide a non-surfactant active particle relative standard deviation of less than or equal to 20%;

(ii) a solid coating aid component having a median particle size of less than 50 microns; and (iii) a binder component, said binder component having a viscosity of less than about 4,000 cps;

b.) a core material having a median particle size of at least 150 microns and a distribution span from 1 to about 2, at least a portion of said core material being coated by said first coating; and c.) optionally, at least one additional coating.

15. A method of cleaning, said method comprising:

a.) contacting at least a portion of a situs with the cleaning composition of claim 1 and/or a composition comprising the cleaning composition of claim 1; and b.) then washing and/or rinsing said situs or said portion of said situs.

16. A process of making a non-surfactant active containing delivery particle comprising the steps of:

a.) combining a non-surfactant active component and a solid coating aid component, having a median particle size of less than 50 microns, to form a pre-mixture; and b.) coating at least a portion of a core material having a median particle size of at least 150 microns and a distribution span from 1 to about 2, with a binder component, said binder component having a viscosity of less than about 4,000 cps and said pre-mixture to form a coated particle;

wherein the non-surfactant active containing delivery particle made comprises:

a.) a first coating comprising:

(i) a non-surfactant active component, said non-surfactant active component being sufficiently evenly dispersed in said coating to provide a non-surfactant active particle relative standard deviation of less than or equal to 20%;

(ii) a solid coating aid component having a median particle size of less than 50 microns, said solid coating aid comprising a material selected from the group consisting of acetates, sulfates, carbonates, borates, phosphates and mixtures thereof; and (iii) a binder component, said binder component having a viscosity of less than about 4,000 cps;

b.) a core material having a median particle size of at least 150 microns and a distribution span from 1 to about 2, at least a portion of said core material being coated by said first coating; and c.) optionally, at least one additional coating.

17. The process claim 16, wherein said coating step is conducted at a Layering Stokes Number of less than 10 and a Core Agglomeration Stokes Number of greater than 0.5.

18. A process of making a non-surfactant active containing delivery particle comprising the steps of:

a.) combining a non-surfactant active component and a binder component, said binder component having a viscosity of less than about 4,000 cps to form a pre-mixture; and b.) coating at least a portion of a core material having a median particle size of at least 150 microns and a distribution span from 1 to about 2, with said pre-mixture and then a solid coating aid component having a median particle size of less than 50 microns to form a coated particle;

wherein the non-surfactant active containing delivery particle made comprises:

a.) a first coating comprising:

(i) a non-surfactant active component, said non-surfactant active component being sufficiently evenly dispersed in said coating to provide a non-surfactant active particle relative standard deviation of less than or equal to 20%;

(ii) a solid coating aid component having a median particle size of less than 50 microns, said solid coating aid comprising a material selected from the group consisting of acetates, sulfates, carbonates, borates, phosphates and mixtures thereof; and (iii) a binder component, said binder component having a viscosity of less than about 4,000 cps;

b.) a core material having a median particle size of at least 150 microns and a distribution span from 1 to about 2, at least a portion of said core material being coated by said first coating; and c.) optionally, at least one additional coating.

19. The process claim 18, wherein said coating step is conducted at a Layering Stokes Number of less than 10 and a Core Agglomeration Stokes Number of greater than 0.5.

* * * * *

UNITED STATES PATENT AND TRADEMARK OFFICE

CERTIFICATE OF CORRECTION

PATENT NO. : 7,671,005 B2
APPLICATION NO. : 11/407617
DATED : March 2, 2010
INVENTOR(S) : Paul R. Mort, III et al.

It is certified that error appears in the above-identified patent and that said Letters Patent is hereby corrected as shown below:

Title Page

References Cited

U.S. Patent Documents

Delete "5,565,137" and insert -- 5,565,422 --.

Column 3

Line 56, delete "Firnenich" and insert -- Firmenich --.

Column 5

Line 65, delete "(Paderbom," and insert -- (Paderborn, --.

Column 10

Line 3, delete "[2-thylhexyl)" and insert -- [(2-ethylhexyl) --.

Claim 3

Line 3, delete "singe" and insert -- single --.

Signed and Sealed this

Thirtieth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,671,005 B2
APPLICATION NO. : 11/407617
DATED : March 2, 2010
INVENTOR(S) : Paul R. Mort, III et al.

It is certified that error appears in the above-identified patent and that said Letters Patent is hereby corrected as shown below:

Title Page

References Cited

U.S. Patent Documents

Delete "5,565,137" and insert -- 5,565,422 --.

Column 3

Line 56, delete "Firnenich" and insert -- Firmenich --.

Column 5

Line 65, delete "(Paderbom," and insert -- (Paderborn, --.

Column 10

Line 3, delete "[2-thylhexyl)" and insert -- [(2-ethylhexyl) --.

Column 18, line 23

(Claim 3, Line 3) delete "singe" and insert -- single --.

This certificate supersedes the Certificate of Correction issued November 30, 2010.

Signed and Sealed this
Twenty-fifth Day of January, 2011

David J. Kappos

David J. Kappos
*Director of the United States Patent and Trademark Office*